United States Patent [19]

Tarumi et al.

[11] Patent Number: 4,827,868

[45] Date of Patent: May 9, 1989

[54] TONER CARRIER FOR DEVELOPING DEVICE FOR ELECTROSTATIC PRINTING APPARATUS

[75] Inventors: Noriyoshi Tarumi, Hachioji; Kazuhiro Nishido, Yokohama, both of Japan

[73] Assignee: Ricoh Company, Ltd., Tokyo, Japan

[21] Appl. No.: 14,602

[22] Filed: Feb. 13, 1987

[30] Foreign Application Priority Data

| | | | |
|---|---|---|---|
| Feb. 19, 1986 | [JP] | Japan | 61-032774 |
| May 26, 1986 | [JP] | Japan | 61-120576 |
| Nov. 13, 1986 | [JP] | Japan | 61-270438 |

[51] Int. Cl.[4] ..... G03G 15/08

[52] U.S. Cl. ..... 118/653; 355/259; 29/130; 29/132

[58] Field of Search ..... 118/653, 651; 355/3 DD; 29/130, 132; 427/194

[56] References Cited

U.S. PATENT DOCUMENTS

| | | | |
|---|---|---|---|
| 3,625,146 | 12/1971 | Hutchison | 29/132 X |
| 3,863,603 | 2/1975 | Buckley et al. | 118/658 |
| 4,100,884 | 7/1978 | Mochizuki et al. | 118/653 |
| 4,196,256 | 4/1980 | Eddy et al. | 427/194 X |
| 4,309,803 | 1/1982 | Blaszak | 29/132 X |
| 4,425,382 | 1/1984 | Tajima | 29/132 X |
| 4,430,406 | 2/1984 | Newkirk et al. | 427/194 X |
| 4,587,699 | 5/1986 | Kadomatsu et al. | 29/132 X |
| 4,646,677 | 3/1987 | Lounsburg, Jr. et al. | 118/653 |
| 4,674,439 | 6/1987 | Sakamoto et al. | 118/657 |
| 4,707,382 | 11/1987 | Tajima et al. | 427/58 |

*Primary Examiner*—Shrive Beck
*Assistant Examiner*—Alain Bashore
*Attorney, Agent, or Firm*—Oblon, Fisher, Spivak, McClelland & Maier

[57] ABSTRACT

A toner carrier in a mono-ingredient nonmagnetic developing device for an electrostatic printing machine which is a roller rotating in contact with a latent image carrier to carry toner on a surface of the latent image carrier, and to develop an electrostatic latent image formed on the latent image carrier with the toner. A toner carrier according to the first invention comprises a rotating shaft, an elastic layer surrounding the shaft, and a thin resin layer built up around the elastic layer or a thin resin cylinder provided with conductivity. A toner carrier according to the second invention comprises a conductive rotating shaft, an elastic layer surrounding the shaft, a thin cylinder surrounding the elastic layer and a toner carrying layer surrounding the cylinder, where the thin cylinder is conductive and the elastic layer is conductive or semi-conductive. And a toner carrier according to the third invention comprises a rotating shaft, an elastic layer surrounding the shaft, and a base consisting of a thin cylinder surrounding the elastic layer, where the elastic layer is made of compression molded soft urethane foam.

4 Claims, 3 Drawing Sheets

TONER CARRIER FOR DEVELOPING DEVICE FOR ELECTROSTATIC PRINTING APPARATUS

FIELD OF THE INVENTION AND RELATED ART STATEMENT

This invention relates to a toner carrier in a mono-ingredient developing device for an electrostatic printing apparatus.

To develop an electrostatic latent image formed on a photosensitive member in the electrostatic photographic copying machine, electrostatic printer, facsimile and other electrostatic printing machine, the developing device in which mono-ingredient toner is employed has been popular because of its small-sized and simple construction.

Here, mono-ingredient toner refers to a developing agent which does not include any carrier.

FIG. 6 shows the main parts of an electrostatic copying machine using such a developing device.

The copying process used in the copying device is well known, that is: A photoconductive photosensitive member 10 formed into drum shape as a latent image carrier is rotated in a direction shown by an arrow, electrostatically charged evenly by a charger 12, and image exposed by exposure light beams L. Then, an electrostatic latent image formed on the photosensitive member 10 is developed by a developing device 20, and a visible image obtained on the photosensitive member 10 is electrostatically transferred onto a transfer printing paper S by a transfer device 14. The transfer printing paper S printed with the visible image is separated from the photosensitive member 10 by the action of ac corona discharge caused by a separator 15, fixed with the visible image by a fixing device (not shown), and then sent out of the copying machine. After the visible image is transferred, the electrostatic charge of the photosensitive member 10 is removed by a charge removing device 16, and the residual toner is taken away by a cleaner 18. OPC (organic photo-conductor), Se, amorphous silicon, CdS, or other compounds are ideal photosensitive materials.

A transfer printing paper S is fed from a cassette (not shown) by a pair of paper feed rollers (not shown), and carried into a transfer printing portion with good timing to transfer printing.

FIG. 7 shows the main parts of a conventional developing device.

As shown in FIG. 7, a non-magnetic mono-ingredient developing device houses in its casing 27 a roller-shape toner carrier 22 rotating in contact with the photosensitive member 10 carrying an electrostatic latent image, a toner feed roller 24 supplying toner T thereon, and an agitator 26 frictionally electrifying by stirring the toner T. The toner T, which is supplied on a circumferential surface of the toner carrier 22 by the toner feed roller 24, and carried to the photosensitive member 10 while being adsorbed electrostatically, is made into thin layers by a doctor blade 28 in contact with the toner carrier 22, charged to a given polarity, and sent to a developing portion in contact with the photosensitive member 10 to develop an electrostatic latent image formed on the photosensitive member 10.

The function of the agitator is to supply the toner feed roller 24 with an adequate amount of toner and to prevent toner T from being blocked.

The developing device 20 shown in FIG. 6 also has a charge removing device, which can be spared.

After development, the toner carrier 22 is deelectrified while passing by a charge-removing member 29. In other words, the charge removing member 29 removes the charge on a surface of the toner carrier 22 after development as well as makes less the charged electricity of the toner itself.

Then, toner left on the toner carrier 22 is scraped off a circumferential surface thereof by the toner feed roller 24.

Since the toner feed roller 24 is rotating in the same direction as the toner carrier 22 while keeping contact with the toner carrier 22, travel directions of both surfaces at a contact portion are reverse to each other. As a result, toner after development is scraped off the circumferential surface of the toner carrier 22 by sliding friction of the surface of the toner feed roller 24.

The above description is the outline of the copying machine and developing device shown in FIG. 6 and of a developing system used therein, where a toner carrier involves some considerations for a latent image carrier.

More particularly, damage on a surface of a latent image carrier (as a photoconductive photosensitive material, OPC, Se, amorphous silicon, Cds, or ZnO compounds are used) will degrade such functions as required for a latent image carrier. But, with the above developing system, development is accomplished by a frictional contact of a toner carrier with a latent image carrier, which may cause damage to the latent image carrier. Thus, adequate considerations should be taken for such damage.

Furthermore, development may be made, using no direct contact (but in the close proximity) of a toner carrier with a latent image carrier, by flying toner toward a latent image carrier under high-frequency bias voltage, but such a close proximity also may bring about unexpected contacts of them caused by misalignment or play of both carriers, thus necessitating such considerations all the same.

To cope with the difficulty, a foamed roller has been used for the toner carrier, but it also involves a failure of resin layers to be built up evenly on the surface, resulting in a poor image quality. Furthermore, if a photosensitive drum, a toner limiting member and a toner supply member described later should keep a continued pressure contact with each other during out-of-service, the contact may cause a local deformation to a toner carrier, resulting in image irregularities.

OBJECT AND SUMMARY OF THE INVENTION

In view of the above, it is the object and purpose of the invention to provide a toner carrier in a mono-ingredient developing device for an electrostatic printing apparatus which does never damage a latent image carrier.

In the present invention of the specification, three aspects are disclosed.

A toner carrier according to the first aspect comprises a rotating shaft, an elastic layer surrounding the shaft, and a thinly built up resin layer or a thin resin cylinder having means for providing conductivity and further surrounding the elastic layer.

A toner carrier according to the second aspect comprises an elastic layer, a thin cylinder and a toner carrying layer surrounding a conductive rotating shaft in the order. The thin cylinder is conductive, and the elastic layer may be conductive or semiconductive.

A toner carrier according to the third aspect comprises a rotating shaft, an elastic layer surrounding the rotating shaft, and a thin cylindrical base, surrounding the elastic layer, which is composed of compression molded soft urethane foam.

BRIEF DESCRIPTION OF THE DRAWINGS

In the accompanying drawings, there are shown illustrative embodiments of the aspect from which these and other of its objectives, novel features and advantages will be readily apparent.

In the drawings.

DETAILED DESCRIPTION OF PREFERRED EMBODIMENTS

Figure 1:
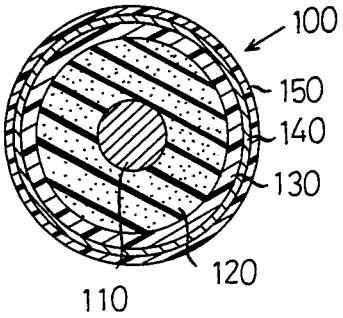
FIG. 1 is a sectional view showing an embodiment according to the first aspect.

In FIG. 1, a toner carrier 100 consists of a rotating shaft 110, an elastic layer 120 made of sponge-like rubber or urethane foam, a thin resin cylinder 130 having a proper thickness and flexibility, a conductive layer 140 and a toner carrying layer 150 made of non-conductive or semi-conductive resin, which surround the rotating shaft 110 in this order. Here, the toner carrying layer is provided as required.

Figure 2:
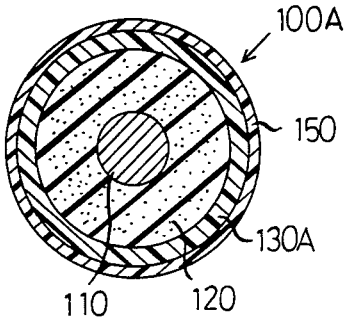
FIG. 2 is a sectional view showing another embodiment according to the first aspect.

Based on the above configuration, the conductive layer 140 functions as an opposite electrode to an electrode of a photosensitive member, and can control an image by applying a proper bias voltage between the conductive layer 140 and the electrode of the photosensitive member. Instead of using the conductive layer 140, like a toner carrier 100A shown in FIG. 2, the thin resin layer 130A itself may be made conductive by including carbon black or other conductive substance therein, where a conductivity over $10^{-10}$ mho/cm is desirable. The same parts in FIG. 2 as those in FIG. 1 are designated by the same numerals as those in FIG. 1.

The toner carrying layer 150 functions to carry toner frictionally charged by an agitator and a toner feed roller, using an electrostatic adsorbing force. Any material, such as non-conductive or semi-conductive resin, which can hold toner electrostatically suffices for the toner carrying layer 150, In the practical selection of the material, important factors are wear resistance, noncohesiveness, coating applicability on the conductive layer and that it should belong to an electrification series which can charge toner to a desired polarity. When organic photosensitive material is used as a photosensitive member, fluororesin or silicon resin particularly superior in noncohesiveness is desirable. A low-resistance toner carrying layer can enhance a developing electrode effect, thus improving an image quality. This low resistance can be obtained by including particulate matter of resistance below $10^{12}$ ohm.cm, such as, carbon black. Furthermore, by using resin having electrically independent and conductive miniature partitions in a toner carrying layer, a conductive-partition-enhanced electrode effect can provide an image having a high contrast.

The use of conductive sponge for an elastic layer 120 is effective in applying bias voltage onto a conductive layer 140.

It is desirable that a thin resin cylinder have adequate flexibility and a thickness of 10 to 200 μm (preferably 20 to 100 μm). Any material, for example, polyester, polycarbonate and fluororesin will do, as far as they have a good formation ability of membrane. A method where developing is made by pressing a toner carrier 100 or 100A to a highly rigid photosensitive drum with an adequately flexible thin resin cylinder 130 on an elastic layer 120 can allow a toner carrier to go along very well with a photosensitive drum, thus resulting in a high quality and high speed image development, as well as, since the elastic layer 120 is pressed through the thin resin layer 130 or 130A, can keep the elastic layer from deforming in out-of-service, thus obtaining a white stripe-free image.

For the second aspect, a metal shaft is preferable for a conductive rotating shaft.

For material of an elastic layer, a variety of rubber such as silicon rubber, foam rubber, and urethane foam or other resin foam is suitable. Conductivity can be obtained by including metal powder, carbon or other conductive powder in these materials or applying a coat thereof. For instance, for urethane foaming, conductive powder can be mixed in during preparation, and for urethane foam already prepared, a coat of conductive powder or paint can be applied thereon.

The elastic layer should have a conductivity not less than $10^{-10}$ mho/cm, preferably over $10^{-8}$ mho/cm.

As the conductive thin cylinder, a hollow Ni thin cylinder formed by electroforming, a hollow thin cylinder made of resin containing conductive powder such as carbon black, or a hollow resin thin cylinder built up with a conductive layer on a surface thereof, can be used.

The toner carrying layer forms a surface of the toner carrier on the outer circumferential surface thereof to carry toner. The toner carrier can be an insulating layer, but it is preferable to have a resistivity of $10^3$ to $10^{12}$ ohm/cm to obtain good counter electrode effect.

Figure 3:
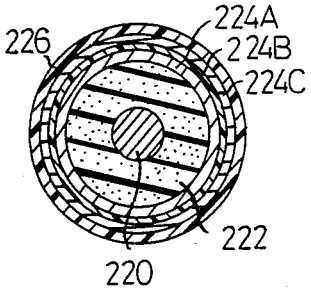
FIG. 3 is a sectional view showing an embodiment according to the second aspect.
Figure 4:
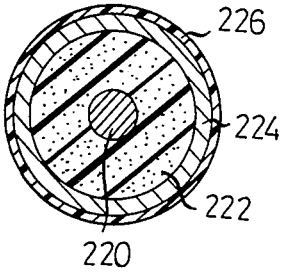
FIG. 4 is a sectional view showing another embodiment according to the second aspect.

FIGS. 3 and 4 show two embodiments of typical configurations of a toner carrier according to the aspect. In FIGS. 3 and 4, the like reference numerals are provided for the like parts regarded as having no possibility of confusion to prevent complication.

Numerals 220, 222 and 226 respectively designate a conductive rotating shaft, an elastic layer and a toner carrying layer.

In FIG. 4, Numeral 224 designates a thin cylinder made from a single block, for which a Ni cylinder formed by electroforming or a hollow thin cylinder made of resin containing conductive powder can be employed.

In FIG. 3, Numeral 224B designates a hollow resin thin cylinder, and conductive layers 224A and 224C built up of resin etc. containing conductive powder are respectively formed on inner and outer circumferential surfaces thereof by such a method as coating. The conductive thin cylinder consists of the aforesaid three portions. Furthermore, the conductive layers 224A and 224C are electrically connected with each other at both ends thereof.

Additionally, for the toner carrier in FIG. 4, if the thin cylinder 224 is made of conductive resin, provision of conductivity to the cylinder slightly impairs the physical properties required for the cylinder. Therefore, the toner carrier as shown in FIG. 3 is more suitable for a resin thin cylinder.

Figure 6:
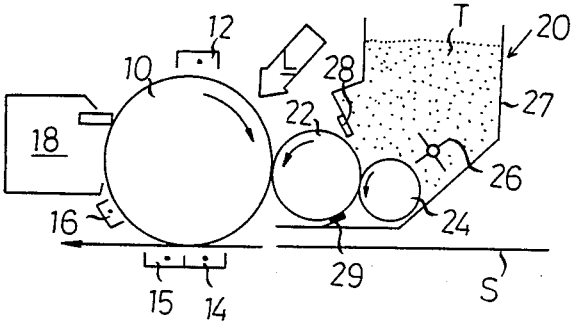
FIG. 6 PRIOR ART
FIG. 6 is a sectional view showing the main parts of the well known electrostatic printing machine.

On the metal rotating shaft an urethane foam (containing carbon black powder) having a conductivity of $10^{-8}$ mho/cm is formed as an elastic layer, and thereon a Ni thin cylinder formed by electroforming is disposed, and further thereon a resin layer having a resistivity of $10^4$ ohm/cm by including metal powder therein is built up as the toner carrying layer, which altogether make a toner carrier of the type shown in FIG. 4, thus obtaining a desired developing effect by using the aforesaid toner carrier in the device as shown in FIG. 6.

Figure 5:
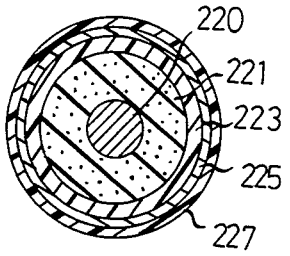
FIG. 5 is a sectional view showing an embodiment according to the third aspect.

FIG. 5 shows an embodiment of a toner carrier according to the third aspect. Numeral 220 designate a rotating shaft similar to those in the embodiments in FIGS. 3 and 4. Numerals 221 and 223 respectively are an elastic layer and a thin layer. A base of the toner carrier consists of the rotating shaft 220, the elastic layer 221 and the thin cylinder 223. On the base, an electrode layer 225 and a toner carrying layer 227 are formed.

The third invention features the elastic layer 221 made of the compression molded urethane foam.

The requirements for the elastic layer in the toner carrier are: A small permanent deformation or a small deformation taking a long time to recover, and a surface roughness which is small enough to avoid such defects as irregularities in an image caused by uneven shapes on the elastic layer surface appearing on the surface of the toner carrier when a thickness of the thin cylinder 223 is very thin.

From these points of view, the compression molded urethane foam is an extremely superior material.

The elastic layer 221 can be formed by compression molding an urethane foam material, e.g. BRIDGESTONE's EVERLIGHT SCOTT of cell number 20 to 50 into an elastic layer, or by compression molding an urethane foam material into an elastic layer after it is laminated on the rotating shaft The compression molding is desirably performed while a temperature of the urethane foam is maintained at a softening temperature 80C to 180C of urethane resin, or while the urethane foam is immersed in a weak solvent just enough to swell the urethane resin (a weak solvent for the urethane resin).

For the thin cylinder 223, a metal cylinder made of electroformed Ni or a resin cylinder formed by extrusion molding is suitable, particularly the latter being desirable. The thickness of the cylinder should be 5 to 500 μm, preferably 20 to 200 μm. When the thin cylinder is made of resin, there is a wide choice of resin material among polyethylene terephthalate, polyurethane resin and polycarbonate resin.

For the toner carrier 227, materials suitable for electrostatically adsorbing and carrying toner, such as nonconductive fluororesin, silicon resin and epoxy resin can be used. In addition, to improve its gradient, a conductive powder such as carbon black can be mixed in the aforesaid resins, or miniature electrodes consisting of a large number of conductive particles electrically insulated with each other can be provided.

A compression molded urethane foam used for the elastic layer enlarges the tolerance of the developing conditions (for instance, pressing force) for a drum-shape latent image carrier, and enhances the reliability of an electrostatic printing apparatus, and further widens a contact width for the latent image carrier, thus resulting in high speed printing.

The compression molded soft urethane foam is also suitable for material for the toner feed roller.

The requirements of the toner feed roller are a good tonercarry property, an appropriate elasticity, a small torque required when rotating in contact with the toner carrier, and also an ability to scratch off toner on the toner carrier.

In addition, it is important for the toner feed carrier to be nearly free from deformation even if kept in static pressure contact with the toner carrier roller for a long time, and also to have an proper surface roughness because a large surface roughness causes an image to have patterns relative to the surface roughness.

From these points of view, the compression molded soft urethane foam is extremely superior for material for the toner feed roller.

Figure 10:
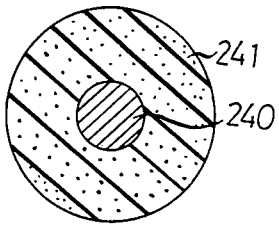
FIG. 10 is a sectional view showing a toner feed roller.

FIG. 10 shows another embodiment of a toner feed roller comprising a rotating shaft 240 and an elastic layer 241 formed thereon and made of a compression molded soft urethane foam. And alternatively the elastic layer 241 can be formed by using a previously compression molded soft urethane foam, or by building up urethane foam on the rotating shaft and compression molding it. The compression molding is successfully performed by compressing urethane foam while keeping its temperature at the softening temperature, or by immersing urethane foam in a weak solvent for urethane resin and removing the solvent under compression. In this manner, an extremely superior toner feed roller can be obtained by compression molded soft urethane foam.

Now, a description of a charge removing member for the toner carrier is supplemented.

To obtain a good development by the toner carrier, it is necessary for every rotation of the toner carrier that toner having contributed to development be removed from the surface of the toner carrier, and that fresh toner be newly added thereon. For this reason, charge removal by the charge removing member (Numeral 29 in FIG. 6) has an important role. In other words, used toner removal and following retention of new toner depend on how successfully charge removal is performed by the charge removing member. For the charge removing member, a conductive brush such as the charge removing member 29 shown in FIG. 6 can be used, but a conductive elastic board is preferable.

Figure 8:
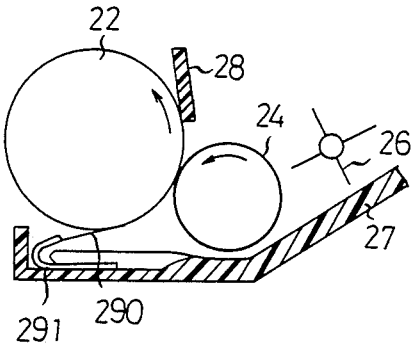
FIG. 8 is a sectional view showing another developing device.

FIG. 8 shows an embodiment using such a conductive elastic board. For the other like parts, the like reference numerals are provided.

A conductive elastic board 290 provided as a charge removing member is securely supported by a support member 291 fixed on a housing 27, and a tip end of the board 290 is elastically brought into contact with a circumference of a toner carrier 22 so as to follow along a rotating direction of the toner carrier 22 to remove charge. A contact pressure of the elastic member 290 is so small that toner can pass through the contact portion without being scratched off as it is left on the toner carrier surface.

Taking into consideration an event when the elastic board 290 should come into tighter contact with the toner carrier at the tip end thereof, sharp burrs on the tip end should be scraped off to keep the surface of the toner carrier from being damaged. The elastic board of less than 0.5 mm in thickness, preferably less than 0.2 mm, is advisable to keep uniform contact with the toner carrier and reduce the pressure applied thereon.

Figure 9A:
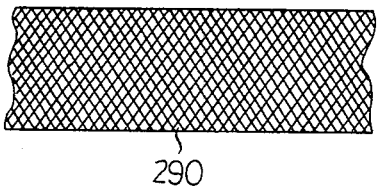
FIG. 9*a* and 9*b* are plan views showing examples of a charge removing member.
Figure 9B:
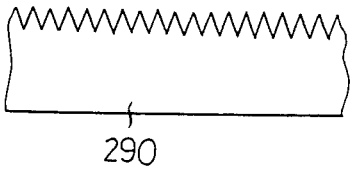
Figure 7:
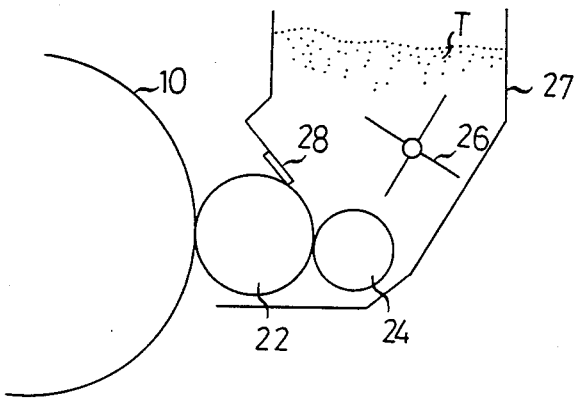
FIG. 7 PRIOR ART
FIG. 7 is an enlarged sectional view showing a developing device in the electrostatic printing machine.

For the elastic board 290, a sheet metal, or a resin film attached with a conductive material on the surface thereof is suitable as its material, and other shapes may be adopted, for example, a screen mesh shape as shown in FIG. 9A and a shape having a number of small projections along an end surface in FIG. 9B, rather than the simply-shaped flat board. The charge removing member having the shape as shown in FIG. 9A or 9B allows charge concentration to be generated therein, thereby enhancing the charge removal as well as giving a better adhesion to and a proper contact pressure on the toner carrier.

It is desirable that the screen mesh shape portion shown in FIG. 9A be made of a film formed by a Ni-based electroforming or etching or the like, On the other hand, it is preferable that the projections in the shape shown in FIG. **9*b*** be formed as closely as possible also by the aforesaid electroforming or etching or the like.

The charge removing member as mentioned above can effectively prevent fall-off of toner from a developing device, and is applicable to many different developing devices using a toner carrier.

The aforesaid constructions of the toner carrier facilitate a developing bias operation without causing damage to the latent image carrier. And the toner carrier can be formed into belt shape, not limited to the roller shape.

Furthermore, a developing device using a toner carrier according to the aspect is applicable to a magnetic monoingredient toner as well as a nonmagnetic monoingredient toner, and also a latent image carrier for the developing device may be dielectric, not limited to photoconductive.

When the toner carrier comes into close contact with the latent image carrier, development is carried out by the aforesaid method wherein a high-frequency developing bias permits the toner to fly toward the latent image.

It will be clear to those skilled in the art that various changes may be made in the aspect without departing from the spirit and scope thereof and therefore the aspect is not limited by that which is shown in the drawings and described in the specification but only as indicated in the appended claims.

What is claimed is:

1. A toner carrier in a developing device using monoingredient developing agent made of toner only which is a roller-shape means, rotating in contact or in the close proximity with a latent image carrier, for carrying toner on a surface thereof, and for developing an electrostatic latent image formed on said latent image carrier with said toner, comprising:

A conductive rotating shaft, a conductive sponge layer surrounding said shaft, said sponge layer having a conductivity over $10^{-8}$ mho/cm, and a conductive cylinder surrounding said conductive sponge layer, a toner carrying layer surrounding said cylinder.

2. A toner carrier in a developing device as claimed in claim 1, wherein said conductive cylinder is a hollow thin cylinder made of Ni prepared by electroforming.

3. A toner carrier in a developing device as claimed in claim 1, wherein said conductive cylinder is made by building up a conductive layer on a surface of a hollow thin resin cylinder.

4. A toner carrier in a developing device as claimed in claim 1, wherein said conductive cylinder is made of resin including conductive powder.

* * * * *